United States Patent [19]

Janssen

[11] 4,133,333

[45] Jan. 9, 1979

[54] SLING SHOT

[76] Inventor: George A. Janssen, P.O. Box 386, Graton, Calif. 95444

[21] Appl. No.: 812,753

[22] Filed: Jul. 5, 1977

[51] Int. Cl.[2] ..... F41B 7/00

[52] U.S. Cl. ..... 124/20 R

[58] Field of Search ..... 124/20 R, 20 A, 41 R, 124/35; 215/321; 273/72 R; 272/142, 137, 136, 144

[56] References Cited

U.S. PATENT DOCUMENTS

| | | | |
|---|---|---|---|
| 1,165,484 | 12/1915 | Zimmerman | 273/72 R |
| 3,749,075 | 7/1973 | Saunders | 124/20 R |

*Primary Examiner*—Richard C. Pinkham
*Assistant Examiner*—William R. Browne
*Attorney, Agent, or Firm*—Melvin R. Stidham

[57] ABSTRACT

An improvement for a slingshot that utilizes a tubular elastic band as the propulsion medium, the ends of the tube being stretched over the ends of the forked rod. The rod ends are formed with one or more grooves or depressions disposed transversely to the axes thereof and a pair of semi-cylindrical plastic shells are hinged together to form a rod end cap with internal ridges that interlock with the grooves. A hinged cap is placed over each rod end to provide a smooth, yieldable surface over which the elastic tube ends are stretched.

8 Claims, 3 Drawing Figures

SLING SHOT

BACKGROUND OF THE INVENTION

Slingshots and catapults commonly available utilize elastic tubes of latex or the like which are stretched over the ends of a divergently forked rod, in the usual slingshot configuration. Even when the tubing extends just a short distance over the ends of the rods, it may be stretched without being pulled off the ends and this friction grip increases in intensity as the tube is stretched, and may even exceed the break strength of the elastic tube. However, if the surface of the latex is interrupted by even a very small cut, it tends to tear very easily, and such tears may be started by extremely small burrs, pits or relatively sharp edges. The de-burring and polishing of the rod ends is a relatively expensive process requiring additional machining and very close quality inspection. Even then, the plating or handling of the metallic slingshot fork can produce relatively sharp burrs or edges and, in fact, same can occur during use of the slingshot, as for example, if the rod end is struck by a misdirected projectile. Moreover, such a projectile grazing or striking the fork end, as when the shooter's hand is lurched or jerked excessively, may crush the wall of the latex tube producing a weakened area rendered susceptible to tearing.

Others have attempted to solve this problem by dipping or otherwise applying a plastic coating or cap to the fork tips. However, whether dipped or preformed and placed, the provision of such coatings or caps usually requires a separate machining operation for secure mechanical retention.

OBJECTS OF THE INVENTION

It is an object of this invention to furnish fork tips for slingshot with caps that provide smooth, burr-free surfaces.

It is a further object of this invention to provide slingshot fork tips with caps that are yieldable.

It is a further object of this invention to provide molded caps for fork tips of a slingshot which are yieldable, and which have a mechanical interlock with the fork tips.

It is a further object of this invention to provide a resilient molded cap for slingshot fork tips which are conditioned for mechanical interlock without requirement of a separate machining operation.

Other objects and advantages of this invention will become apparent from the description to follow, particularly when read in conjunction with accompanying drawing.

SUMMARY OF THE INVENTION

In carrying out this invention I provide, during the formation of a divergent fork slingshot, which is bent from metal rod into two diverging upstanding members with rearwardly extending fork tips, grooves or depressions in the fork tips. Received over the fork tips are generally cylindrical caps which may be formed as two semi-cylindrical shells which are hinged together at two adjacent edges. The shells have interior projections therein which are spaced to be received in the recesses in the fork tips to provide a mechanical interlock therewith. The caps are formed of a relatively resilient material to reduce any tendency to initiate a cut in the latex tubing which is stretched over them as the propulsion medium for the slingshot. In addition, the resiliency provides a cushion in the event of impact from a misdirected shot, and the plastic material has cold flow characteristics whereby the constrictive forces of the latex tubing stretched around them causes them to unite firmly with the fork tip ridges for maximum retentive characteristics.

DESCRIPTION OF A PREFERRED EMBODIMENT

Figure 1:
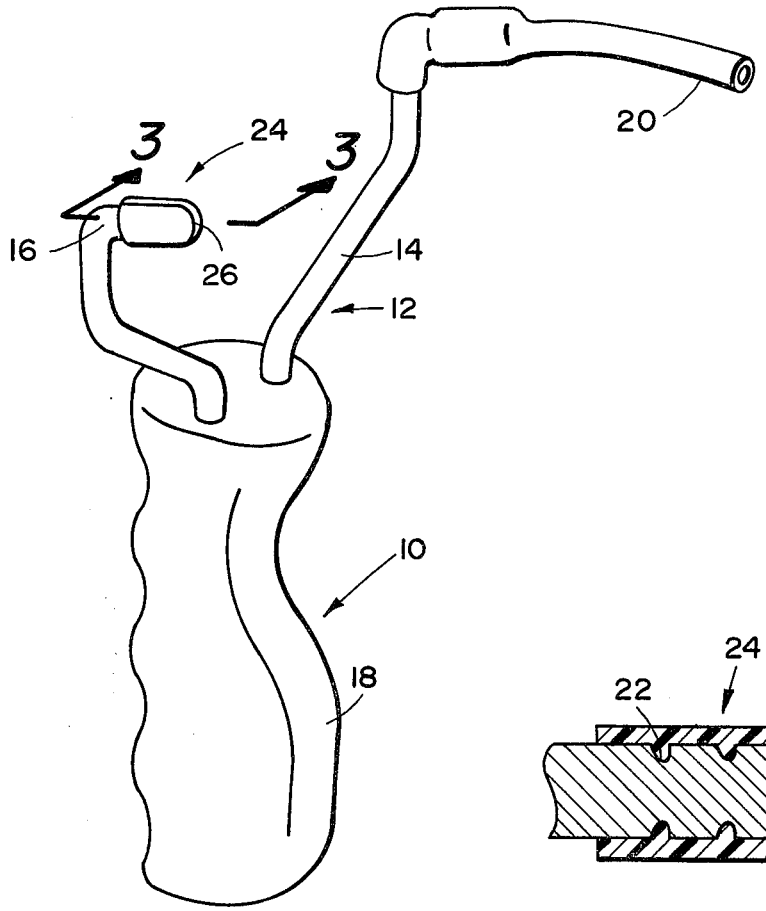
FIG. 1 is a view in perspective of a slingshot embodying features of this invention.

Referring now to the drawing with greater particularity there is shown a slingshot 10 which may include fork members 12 formed by bending metal rod in a die, whereby the forks diverge at 14 and terminate at 16 in rearward extending fork tips 14. The forks 12 may be secured in a suitable handle 18 of a relatively hard plastic or the like.

Stretched over the fork tips 16 are the ends of an elastic tubing 20, of a suitable elastic material such as latex. The other ends of the latex tubing may be secured to a sling pocket or leather or the like and, if desired, the slingshot may also include a suitable wrist brace (not shown).

Figure 3:
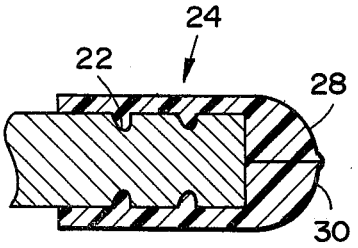
FIG. 3 is a section view taken along line 3—3 of FIG. 1
Figure 2:
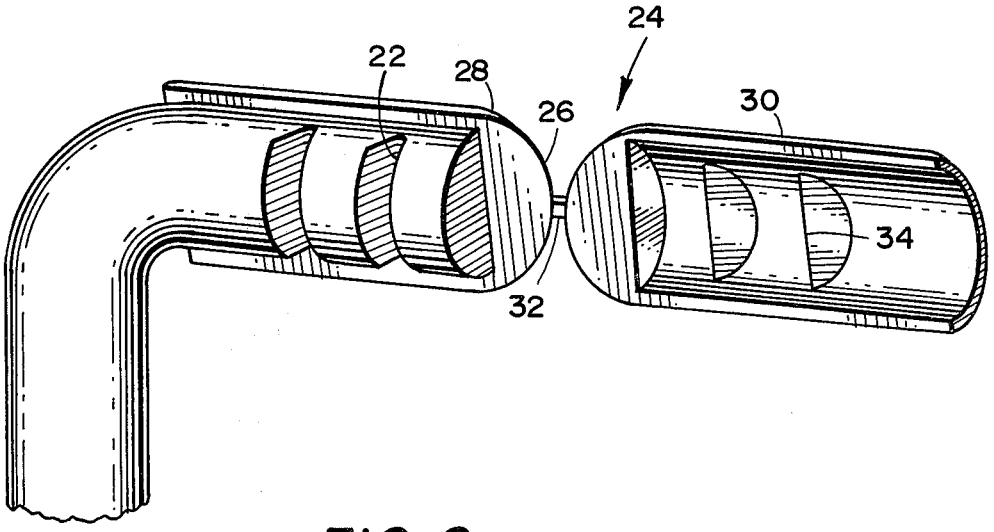
FIG. 2 is an enlarged view of a fork tip and the protective cap of this invention.

Referring now to FIGS. 2 and 3 more specifically, the rod ends of fork tips 16, when formed in the die may have channels or grooves 22 depressed therein extending transversely of the axis of the rod to provide mechanical holding members. Of particular significance is the location of the channels on the tips 16 in such a manner that they may be impressed during the formation of the diverging forks in a standard wire forming machine. For example, the slingshot rod 12 shown is bent by forces acting in a plurality of directions, e.g. both laterally and fore and aft. Hence, the depressions 22 are disposed so that they may be impressed during any one or more of such bending operations.

Carried on the fork tips 16 are generally cylindrical caps 24 of a suitable, relatively resilient plastic, such as a vinyl, having a rounded trailing end 26 which is relatively thick to cushion against blows from misdirected missiles.

The caps are preferably formed in two semi-cylindrical shells 28 and 30, which are interconnected, as for example at their trailing ends 26, by a small integral hinge member 32. The shells are molded with transverse ridges 34 which engage into the slots or depressions 22 on the fork tips to provide a mechanical interlock, resisting displacement from the fork tips 16. Moreover, the plastic material selected for the caps 24 preferably has characteristics of cold flow whereby the material will flow into the channels 22 of the fork tips under the constructive forces of the strectching latex tubes around them, to conform rather precisely thereto. This reduces the need for close tolerances in forming the fork tips and in molding the caps 24. The caps provide very smooth resilient surfaces to engage the interior of the latex tubing and minimize the chance of tearing, and to provide a resilient cushion against impact, greatly enhancing the life expectancy of the latex tubing.

While this invention has been described in conjunction with a preferred embodiment thereof, it is obvious that modifications and changes therein may be made by those skilled in the art without departing from the spirit and scope of this invention, as defined by the claims appended hereto.

What is claimed as invention is:

1. In a slingshot comprising:
a handle;
a divergently forked metal rod carried on said handle to extend upwardly therefrom;
tip portions of said forked rod extending in a rearward direction; and
elastic tubing with ends thereof stretched over said fork tip portions;
the improvement comprising;
caps of a resilient material carried over said fork tip portions within said tubing ends; and
complementary mechanical interlock means on said caps and fork tip portions; p1 each of said caps comprising:
a pair of generally semi-cylindrical shells which together fit over a fork tip portion; and
a hinge member interconnecting said shells.

2. The slingshot improvement defined by claim 1 wherein said interlock means comprises;
interengaging ridges and depressions disposed transversely of the axes of said fork tip portions.

3. The slingshot improvement defined by claim 1 wherein:
said cap includes
a trailing end portion thereof of relatively thick rounded configuration covering the extremities of said fork tip portions.

4. The slingshot improvement defined by claim 1 wherein said interlock means comprises:

interengaging ridges and depressions on said caps and fork tip portions, respectively:
said metal rod being bent to form said divergent fork with rearward extending tip portions;
said ridges being disposed so as to be impressed by forces producing such bends.

5. In a slingshot comprising:
a handle;
a forked metal rod carried on said handle to extend upwardly therefrom;
tip portions of said forked rod extending in a rearward direction; and
elastic tubing with ends thereof stretched over said fork tip portions;
the improvement comprising;
caps of a resilient material having cold flow characteristics carried over said fork tip portions within said tubing ends; p1 at least one pair of grooves across said tip portions on opposite sides thereof; and
complementary ridges in said caps;
said tubing ends applying constrictive forces around said caps.

6. The slingshot improvement defined by claim 5 wherein said caps include;
trailing end portions thereof of relatively thick rounded configuration covering the extremities of said fork tip portions.

7. The slingshot improvement defined by claim 5 wherein:
said metal rod is bent to form said fork with rearward extending tip portions;
said grooves being disposed so as to be impressed by forces producing such bends.

8. The slingshot improvement defined by claim 5 wherein:
there are more than one pair of grooves across said end portions.

* * * * *